United States Patent [19]

Boyd

[11] 4,328,756

[45] May 11, 1982

[54] SEWING MACHINE THREAD TENSION CONTROL SYSTEM

[76] Inventor: Gene A. Boyd, 1985 Apple Ave., Muskegon, Mich. 49442

[21] Appl. No.: 110,234

[22] Filed: Jan. 7, 1980

Related U.S. Application Data

[63] Continuation-in-part of Ser. No. 890,035, Mar. 27, 1978, abandoned.

[51] Int. Cl.[3] ..... D05B 47/02

[52] U.S. Cl. ..... 112/254; 112/261

[58] Field of Search ..... 112/261, 59, 97, 254

[56] References Cited

U.S. PATENT DOCUMENTS

| | | | |
|---|---|---|---|
| 89,489 | 4/1869 | Lyon | 112/254 X |
| 122,858 | 1/1872 | Sheldon | 242/153 |
| 729,604 | 6/1903 | Kieffer | 112/59 UX |
| 1,052,014 | 2/1913 | Schoenfeld | 112/97 |
| 2,289,232 | 7/1942 | Babcock | 264/290 N |
| 2,645,196 | 7/1953 | Secrest | 112/254 |
| 2,647,478 | 8/1953 | Eastman | 112/59 X |
| 2,730,061 | 1/1956 | Czajkowski | 112/254 |
| 2,910,951 | 11/1959 | Irmscher | 112/242 |
| 2,957,645 | 10/1960 | Wenz et al. | 242/150 |
| 3,140,682 | 7/1964 | Hale et al. | 112/242 |
| 3,161,913 | 12/1964 | Pound | 242/153 |
| 3,528,379 | 9/1970 | Miller et al. | 112/254 X |
| 3,565,027 | 2/1971 | Miller et al. | 112/255 |
| 3,601,074 | 8/1971 | Von Hagen | 112/254 X |
| 3,841,248 | 10/1974 | Adams et al. | 112/254 |
| 4,030,431 | 6/1977 | Martin et al. | 112/261 X |
| 4,111,140 | 9/1978 | Gonnai et al. | 112/254 |

FOREIGN PATENT DOCUMENTS

| | | | |
|---|---|---|---|
| Ad.78205 | 8/1962 | France | 112/254 |
| 2118390 | 7/1972 | France | 112/254 |

*Primary Examiner*—W. Carter Reynolds

*Attorney, Agent, or Firm*—Price, Heneveld, Huizenga & Cooper

[57] ABSTRACT

A thread tension control system for a sewing machine comprises the following elements arranged in sequence in a path of thread travel extending between the thread supply and needle of a sewing machine, an infinitely variable thread tension control device; a tortuous path thread tension control device; a check spring; and a take-up arm. The tortuous path thread tension control device comprises a generally cylindrical thread tension control post for receiving at least one wrap of thread, the thread tension control post being disposed approximately orthogonal to the path of thread travel. The tension control post is disposed in the path of thread travel between the infinitely variable thread tension control device and in the check spring to effectively multiply the tension provided by the infinitely variable thread tension control device and insulate the same from changes in pressure along the stitch line.

13 Claims, 5 Drawing Figures

SEWING MACHINE THREAD TENSION CONTROL SYSTEM

This is a continuation-in-part application of copending U.S. Patent application Ser. No. 890,035 filed Mar. 27, 1978 and entitled TENSION CONTROL POST.

BACKGROUND OF THE INVENTION

The invention relates generally to apparatus for tensioning the needle thread of a sewing machine. More particularly, the invention is directed to a sewing machine thread tension control system comprising an infinitely variable thread tension control device and a tortuous path thread tension control device.

In general, prior art needle thread tensioning devices for sewing machines can be divided into two broad categories. Tortuous path type tension control devices and infinitely variable type thread tension control devices. Tension control devices of the tortuous path type include apertured rods and various shaped posts through which or around which the thread that is to be tensioned is threaded or wrapped. This type of tension control device was probably the earliest type of tension control device employed to control the dispensing of needle thread on a sewing machine. Problems with this type of thread tension control device stem from the fact that the tension provided can only be varied in a stepwise or quantum manner and thus cannot be easily varied for different sewing conditions. Many of these prior art thread tension control devices also require somewhat of a complicated threading procedure.

This led to the development of infinitely variable thread tension control devices, the most common of which is known in the art as a tension disc assembly. The conventional tension disc assembly includes a pair of cooperating thread tension discs journaled on a common shaft. The thread to be tensioned is threaded between the tension discs. The contact pressure and thus the thread tension provided by the tension discs is determined by tension springs which exert a pressure on one or both of the tension discs. The contact pressure exerted by the discs is infinitely adjustable with the aid of a tension regulating nut.

The tension control system most commonly supplied on sewing machines today includes a tension disc assembly in combination with a take-up arm and check spring. Needle thread is threaded from the spool around the tension disc assembly through the check spring, the take-up arm and the needle. In operation, the needle moves downwardly penetrating the fabric and dragging a loop of thread through the fabric. As the needle reverses its direction and begins to travel upward, friction between the thread and the fabric leaves a loop of thread extending below the fabric. This loop of thread is picked up by a shuttle or hook and looped around the bobbin. During this process, the take-up arm moves downward releasing the tension on the thread to allow the loop protruding from the bottom of the fabric to be passed around the bobbin. After the loop has passed around the bobbin effectively crossing the needle and bobbin threads below the fabric, the take-up arm again moves up drawing the slack from the loop around the bobbin and tightening the stitch. The check spring disposed between the tension disc assembly and the take-up arm serves to cushion any increase in thread tension that may be caused by the action of the take-up arm during this stitch tightening process. The check spring additionally functions to determine the time at which pressure on the upper thread is released prior to loop formation. An increase or decrease in the preload of the check spring reduces or increases the amount of thread available for loop formation and delays or advances, respectively, the timing of loop formation.

Problems with prior art tension control systems of the infinitely variable type result from variations in frictional forces generated between the thread and the fabric, or variations in pressure along the stitch line. Characteristically, these variations occur when sewing with different types and thicknesses of thread and fabric and may also occur with changes in denier of any given sample of thread. These variations cause uneven amounts of thread to be available for the formation of any given stitch leading to uneven stitch formation. For example, when sewing over seams or overlapped fabrics, changes in pressure along the stitch line cause the take-up arm to pull too much additional thread off the spool. As a result, the take-up arm fails to pull the stitches up as tightly and uniformly as they should be pulled.

Prior art infinitely variable thread tension control devices apply comparatively large amounts of pressure to the thread as it is being pulled between the tension discs. This can cause wear or grooving of parts of the tension disc assembly that are vital to its operation. This wear problem is accelerated by the use of modern threads such as polyester which were not in general use at the time that many of these prior art tension control devices were designed.

Another problem with prior art tension control systems of the type employing a tension disc assembly alone is that the tension disc often can not be disposed as close as possible to the check spring thereby minimizing thread stretching. Again, this is particularly important with modern synthetic threads that easily stretch. Since the coefficient of static friction is higher than the coefficient of dynamic friction energy stored in a stretched length of thread in the tension control system can pull unwanted thread from the spool during portions of the sewing process when the thread first begins moving.

The prior art also reveals examples of sewing machine thread tension control systems including the combination of an infinitely variable tension control device and a tortuous path tension control device. However, these prior art sewing machine thread tension control systems do not solve the aforementioned problems, in particular, these systems do not teach an increase in the range of thread tension available from an infinitely variable thread tension control device or the buffering of components in the thread tension control system from changes in pressure along the stitch line. These prior art systems fail to achieve these goals because of the type of tortuous path tension control devices used and because of the manner in which tortuous path tension control devices are combined in the path of thread travel with infinitely variable type thread tension control devices. The stated goal of these prior art combinations is to create a tension control system comprised of a number of tension control elements having an additive effect on thread tension.

SUMMARY OF THE INVENTION

According to the present invention, these and other problems in the prior art are solved by provision of a thread tension control system for a sewing machine comprising the following elements arranged in sequence in a path of thread travel extending from the thread supply to the needle of the sewing machine, an infinitely variable thread tension control device; a tortuous path thread tension control device; a check spring; and a take-up arm. The tortuous path thread tension control device is of a type comprising a generally cylindrical thread tension control post for receiving at least one wrap of thread; the tension control post being disposed approximately orthogonal to the path of thread travel. The tension control post is disposed in the path of thread travel between the infinitely variable thread tension control device and the check spring to effectively multiply or amplify the tension setting of the infinitely variable thread tension control device and insulate or buffer the same from changes in pressure along the stitch line. The increased tensioning abilities provided by this multiplying effect allows the operator to decrease the tension setting of the infinitely variable thread tension control device thereby substantially decreasing wear of the device and substantially decreasing the necessary tension range of the device. The buffering effect of the tension control system eliminates the problems heretofore encountered with changes in denier of a given length of thread or changes in the type or thickness of fabric being sewn which heretofore resulted in uneven stitch formation. Thread stretching in the tension control system can also be minimized by placing the tension control post as close as possible to the check spring. Thus, the thread tension control system of the present invention provides a thread tension control system accommodating a wider range of thread sizes and a wider range of tension values while providing more uniform stitch quality with threads of varying diameter and denier and fabrics of varying thickness.

DESCRIPTION OF THE PREFERRED EMBODIMENTS

Figure 1:
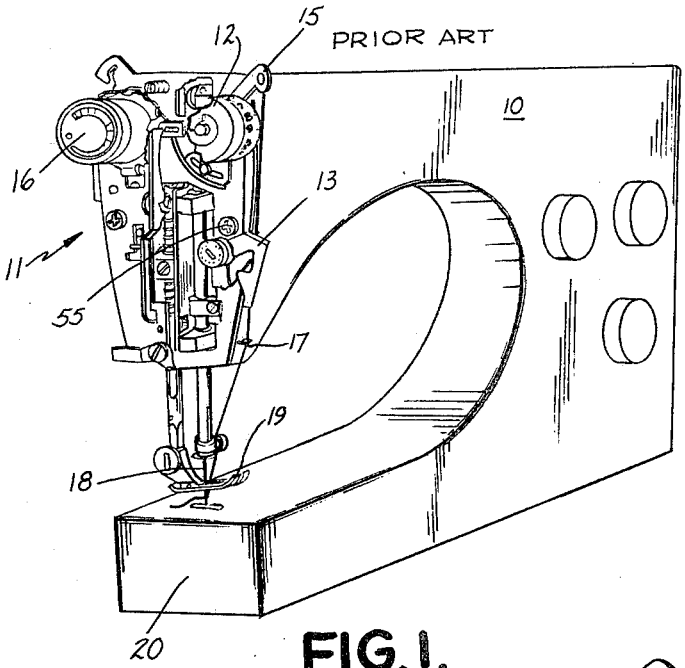
FIG. 1 is a perspective view, partially in section, of a prior art sewing machine and needle thread tension system.

With reference to FIG. 1, the operation of a conventional sewing machine 10 is described. The sewing machine 10 includes a needle thread tension control system generally indicated by the numeral 11. The thread tension control system 11 is of the type having a single tension disc assembly 12 for infinitely varying the thread tension provided by the system. The thread tension control system further includes a check spring 13 and a take-up arm 15. Thread flows from a thread supply or spool disposed at 16 to a needle at 18 defining a path of thread travel therebetween. More specifically, the thread passes from the spool 16 between the tension discs of assembly 12 through the check spring 13, the take-up arm 15 and an eyelet 17 to the needle 18. In the operation of this thread tension control system, the needle 18 moves downward penetrating the fabric pinned under the foot 19 thereby dragging a loop of thread through the fabric. As the needle 18 moves downward the take-up arm follows allowing the thread to be drawn down into the fabric. When the needle 18 reverses its direction of travel, moving upward, friction between the thread and the fabric provides a loop of thread extending below the fabric which is picked up by a shuttle or hook and looped around a bobbin assembly disposed in the base 20 of the machine 10. After the loop is completed around the bobbin assembly, crossing the needle and bobbin threads below the fabric, the take-up arm again moves upward to the position illustrated in FIG. 1 drawing the slack from the loop around the bobbin assembly and tightening the stitch.

Figure 2:
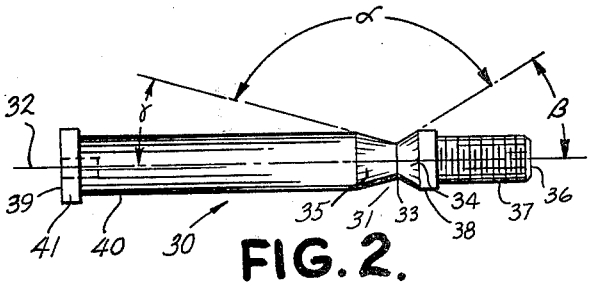
FIG. 2 is a plane view of a tortuous path type tension control device constructed according to the present invention.

Referring now to FIG. 2, a tortuous path thread tension control device 30 constructed according to the present invention is illustrated. The tension control device 30 comprises a generally cylindrical thread tension control post. The control post 30 is adapted for installation in a tension control system orthogonally oriented with respect to the path of thread travel of the control system. The control post receives one or more wraps of thread and tension may be varied in a step-wise manner by varying the number of wraps of thread about the post. The tension provided by the post may also be varied by substituting posts having varying surface roughnesses. The control post 30 includes means for guiding the thread comprising a circumferential groove 31 for receiving at least one wrap of thread. The circumferential groove 31 is disposed in a plane approximately orthogonal to the central axis 32 of the thread control post. The plane includes at least a portion of the path of travel of the thread in the tension control system. The circumferential groove 31 preferably is V-shaped in cross section and includes an apex 33 having a radius of approximately 1/64". However, grooves with other cross-sectional configurations may be employed. The circumferential groove 31 is an important feature of the invention since it restricts movement in the axial direction of the loop of thread disposed about the post. Without the circumferential groove 31, the wrap of thread disposed about the control post will unravel and wander during portions of the sewing cycle when thread tension is reduced. Any unravelling or axial travel of the loop will serve to reduce the thread multiplying effect of the post when the post is disposed in the tension control system of the present invention. Thus, the circumferential groove 31 serves to keep the loop of thread wrapped about the post in a single plane orthogonal to the central axis 32 of the control post which includes the path of travel of the thread. The apex 33 of circumferential groove 31 defines a minimum diameter for the control post 30 which, in most applications, is in a range of 1/16" to $\frac{3}{8}$". A preferred range for the thread tension control post diameter is 1/16" to $\kappa$".

The V-shaped circumferential groove 31 includes first and second opposing circumferential faces 34 and 35 having an included angle $\alpha$ of approximately 135°. The first circumferential surface 34 faces outboard of the machine and forms an angle $\beta$ of approximately 30° with respect to the central axis 32 of the control post 30. The second circumferential face 35 faces inboard of the machine and forms an angle $\gamma$ of approximately 15 ° with respect to the central axis 32 of the control post 30. The inboard end 36 of the control post 30 is provided with threads 37 and normally the machine is provided with a threaded aperture for receiving the inboard end 35 of the control post 30. For example, in the case of the machine illustrated in FIG. 1, the thread tension control post 30 engages the threads provided for receiving machine screw 55. The control post 30 also includes a first annular shoulder 38 disposed between the threaded portion 37 and the circumferential groove 31 for positioning the circumferential groove 31 in the path of travel of the thread. The outboard end 39 of the thread control post 30 includes a winding mandrel to aid in wrapping the thread about the control post 30. The winding mandrel comprises a cylindrical body portion 40 and a second annular shoulder 41. The cylindrical body 40 is disposed between the circumferential groove 31 and the outboard end 39 of the control post. The second annular shoulder 41 is disposed on the outboard end 39 of the control post.

Figure 3:
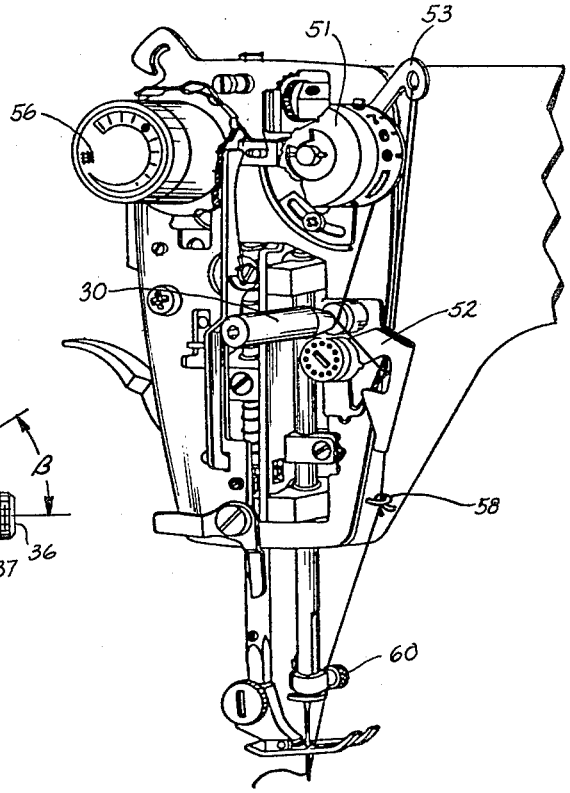
FIG. 3 is a perspective view, partially in section, of a thread tension control system constructed according to the present invention.
Figure 5:
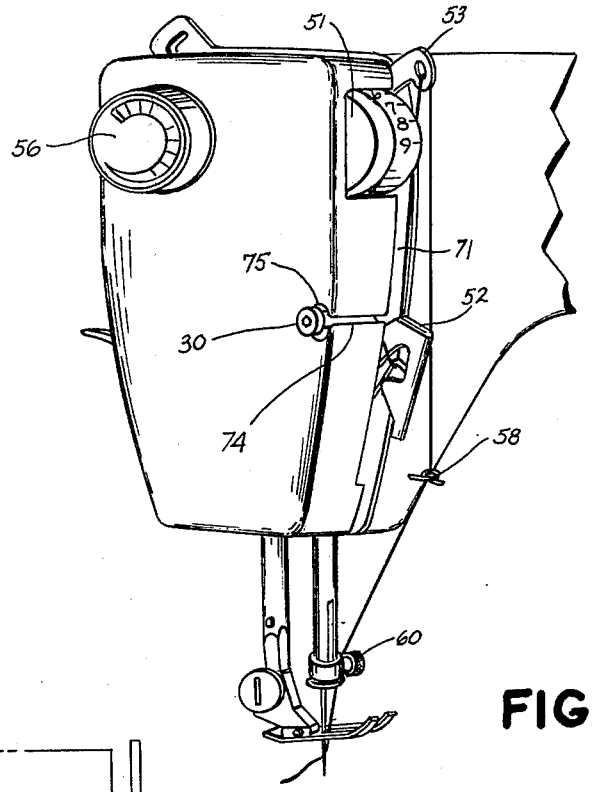
FIG. 5 is a perspective view of a thread tension control system constructed according to the present invention shown with the cover installed.

Referring now to FIG. 3, the needle thread tension control system of the present invention is illustrated. According to the present invention, the tension control post 30 of the present invention is combined with an infinitely variable thread tension control device 51. In this case, a sewing machine having a recessed tension disc assembly 51 is specifically chosen since such recessed tension disc assemblies include a separate check spring 52. Most prior art tension disc assemblies incorporate the check spring in the tension disc assembly. However, in the case of a tension disc assembly normally recessed under the cover of a machine, (as illustrated in FIG. 5) a complete wrap of thread cannot be disposed about the tension disc assembly. The thread extends from the spool 56 to the tension disc assembly 51 where the path of thread travel turns approximately 90° downwardly to the check spring 52. This allows the user to thread the tension disc assembly by simply laying the thread between the tension discs of the assembly. Without a full wrap of thread disposed about the tension disc assembly 51, tension disc assemblies having a built-in check spring are unsuitable. In addition to the tension disc assembly 51 and the check spring 52, the tension control system of the present invention includes the tension control post 30 and a take-up arm 53. The thread tension control post 30 may be threadably or otherwise suitably secured to the machine and is disposed orthogonally to the path of thread travel in the tension control system of the machine.

Thus, the thread tension control system of the present invention comprises the following elements arranged in sequence in the path of thread travel extending between the thread supply 56 and the needle 60. An infinitely variable thread tension control device 51, a tortuous path thread tension control device comprising a generally cylindrical thread tension control post 30 disposed orthogonally to the path of thread travel, a check spring 52 and a take-up arm 53. To thread the tension control system of FIG. 3, needle thread from the spool 56 is passed between the tension discs of assembly 51 and around the thread tension control post 30. Thread from the control post 30 is threaded under the check spring 52 through the take-up arm 53 and eyelet 58 to the needle assembly, generally indicated by the numeral 60. Normally, only one wrap of thread is disposed about the thread tension post 30. However, if it is desirable to increase the tension provided by the tension control system in a step-wise or quantum manner, one or more additional wraps of thread may be disposed about the control post 30. It is normally not necessary to use more than one wrap of thread about the tension control post 30 since with a single wrap of thread disposed about the tension control post, a range of thread tension adjustment is provided that is substantially greater than that provided with the tension disc assembly alone. The greater range of tension adjustment is a result of the tension multiplying effect of the tension control post 30. The tension multiplying effect referred to is created by the orthogonally arranged tension control post disposed in a tension control system downstream of an infinitely variable thread tension control device and upstream of a check spring.

The multiplicative effect referred to is defined as follows. The total tension created by both the tension disc 51 and the control post 30 can always be expressed as a factor or multiple of the tension supplied by the tension disc 51 alone. Rather than analytically deriving the relationship between the needle thread tension before and after the tension control post, pages 3-45 and 3-46 of *Marks Standard Handbook for Mechanical Engineers,* 7th Ed. 1967, published by McGraw-Hill, Inc., are referred to and hereby incorporated by reference. The standard analysis provided by Marks reveals that where the tensions $T_1$ and $T_2$ are the tensions in a rope or the like strained over a drum, sheave, pulley or the like, the difference $T_1-T_2$ must equal the circumferential force P transferred by friction from the drum to the rope. If f equals the coefficient of friction (either static or dynamic) between the rope and the drum, and a equals the angle subtending the arc of contact between the drum and the rope according to Marks:

$$T_1 = T_2 e^{fa} \quad (1)$$

Applying this analysis to the thread tension control post of the present invention $T_2$ represents the tension established by the tension disc assembly 51 and $T_1$ represents the tension established downstream of the tension control post 30 by their combined effect. In this analysis, it is of course assumed that the tension required to unwind thread from the thread supply or spool 56 is negligible. Assuming that a single wrap of thread surrounds the tension control post, the angle a is approximately 360°. Assuming further that a coefficient of dynamic friction f is equal to approximately 0.15:

$$e^{fa} = 2.57 \quad (2)$$

Thus:

$$T_1 = 2.57\ T_2 \quad (3)$$

Similarly, where two wraps of thread are disposed about the control post 30, the angle is equal to approximately 720° and:

$$T_1 = 6.59\ T_2 \quad (4)$$

With the application of the standard analysis provided by Marks, it becomes clear that the needle thread tension downstream of the tension control post is always a function of the tension disc setting. More specifically, the tension $T_1$ downstream of the tension control post is always related to the tension $T_2$ (at any tension disc setting) by a factor that is a function of the coefficient of friction between the thread and the post and the arc through which the thread is in contact with the post. Thus, although other conditions may effect the coefficient of friction between the thread and the post, when appropriately positioned in the thread control system, the effect of the post 30 is to amplify or multiply the tension setting of the tension disc assembly 51.

Significantly, this tension multiplying effect also provides a buffering effect with regard to the changes in pressure along the stitch line previously referred to. In this regard, it has been observed that with the thread tension control system of the present invention, much greater sewing resistances or changes in pressure along the stitch line may be encountered without reflecting or transferring back through the tension control system an increased demand for thread from the spool 56. To illustrate why this buffering or braking effect occurs, an analogy is drawn to the fact that by casting a rope over an overhead beam, a man can easily be pulled off of his feet by a weight disposed on the other end of the rope that is only somewhat greater than his body weight. However, if a single wrap of the rope is disposed about the beam, the braking or clamping effect of this wrap of rope disposed about the beam allows one to suspend a weight on the opposite end of the rope that is substantially greater than one's own body weight. Thus, in addition to providing a thread tension control system that is adjustable for a wider range of sewing conditions, and one that provides for less wear of infinitely variable thread tension control components because of their operation at much lower tension settings, the needle thread tension control system of the present device is no longer sensitive to changes in pressure along the stitch line generated by overlapping fabric seams, changes in denier of a given sample of thread or the like. The thread tension control system of the present invention supplies a stitch of superior quality when sewing under the aforementioned conditions which vary the frictional forces generated between the thread and the fabric. Furthermore, the system is somewhat self adjusting for various diameter needle threads. When the thread on the spool is changed without changing the thickness of the bobbin thread, the clamping effect of the thread wrapped about the tension control post 30 provides the necessary additional tension required to allow the take-up arm 53 to pull the thread back through the fabric without pulling too much additional thread off of the spool.

The multiplicative effect of the tension control post 30 on the tension setting of the tension disc assembly 51 is significant since the tension setting of the tension disc assembly 51, or any other infinitely variable thread tension control device used in the thread tension control system of the present invention, may be substantially reduced for most sewing operations. Significantly, a sufficient range of tension adjustment is often still available after removing one or more of the biasing springs of a conventional tension disc assembly. With the pressure in the tension disc assembly so reduced under normal sewing operations, wear of the tension disc assembly, particularly with the use of synthetic threads such as polyester or the like, is substantially reduced. This tension multiplying effect significantly enhances the feasability of electronically controlled and programmed infinitely variable thread tension control devices. Such infinitely variable thread tension control devices provide tension settings that vary during the sewing process according to the type of stitch being sewn and sewing conditions encountered. When the control post and tension multiplier of the present invention is combined in such a system, it dramatically reduces the range of tension values necessary in the electronically controlled infinitely variable thread tension control device.

Problems related to thread stretching in the tension control system can also be minimized by positioning the control post 30 as close as possible to the check spring 52 thereby minimizing the length of needle thread subjected to the full sewing tension.

Figure 4:
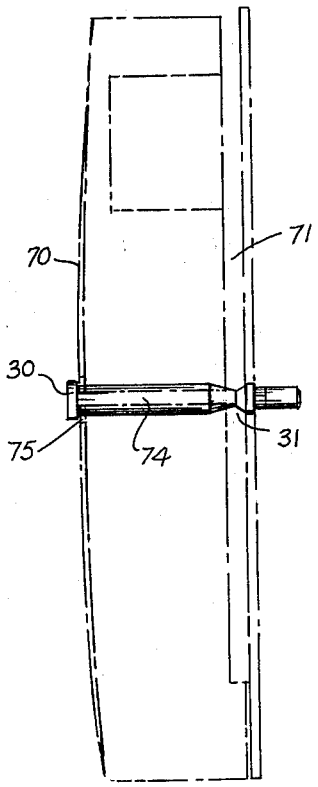
FIG. 4 is an elevational view of a tortuous path type tension control device, constructed according to the invention, installed on a sewing machine with a cover shown in phantom.

Referring now to FIGS. 4 and 5, a cover 70 for the needle thread tension control system of the present invention is illustrated. Referring now specifically to FIG. 4, where the cover 70 is illustrated in phantom, the cover is provided with a generally vertical slot 71 through which the take-up arm 35 normally extends. The vertical slot 71 is disposed in a plane including the path of thread travel of the needle thread. Thus, as illustrated in FIG. 4, the circumferential groove 31 of the control post 30 is centered in the vertical slot 71. The cover 70 is further provided with a horizontal slot 74 extending along the front of the cover from the vertical slot 71 to an opening 75 on the side of the cover 70. The opening 75 is provided so that the winding mandrel of the thread tension control post 30 can extend from the side of the cover 70. Thus, even with the cover 70 installed over the thread tension control system, the thread tension control system including the control post 30 recessed behind the cover, can be threaded and the number of wraps taken about the control post 30 may be varied.

The above description should be considered as exemplary and that of the preferred embodiment only. The true spirit and scope of the present invention should be determined by reference to the appended claims.

The embodiments of the invention in which an exclusive property or privilege is claimed are defined as follows:

1. In a needle thread tension control system for a sewing machine comprising the following elements arranged in sequence in a path of thread travel extending from a thread supply to a needle:

an infinitely variable thread tension control device;

a tortuous path thread tension control device, said tortuous path thread tension control device comprising:

(i) a generally cylindrical thread tension control post for receiving at least one wrap of thread;

(ii) said thread tension control post being disposed approximately orthogonal to the path of thread travel;

a check spring; and a take-up arm;

said tension control post being disposed in the path of thread travel between said infinitely variable thread tension control device and said check spring to effectively multiply the tension provided by said infinitely variable thread tension control device and insulate the same from changes in pressure along the stitch line.

2. The needle thread tension control system of claim 1 wherein said infinitely variable thread control device comprises a tension disc assembly.

3. The needle tension control system of claim 1 further including means for guiding said wrap of thread in a plane extending generally parallel to the path of thread travel and orthogonal to the axial centerline of said tension control post.

4. The needle thread tension control system of claim 3 wherein said means for guiding comprises a circumferential groove for receiving said wrap of thread.

5. The needle thread tension control system of claim 4 wherein said circumferential groove is provided with a V-shaped cross section.

6. The needle thread tension control system of claim 5 wherein said cross section includes an apex having a radius of approximately 1/64 of an inch.

7. The needle thread tension control system of claim 5 wherein said V-shaped cross section includes an apex defining the diameter of said thread tension control post in a range of 1/16 to $\frac{1}{4}$ of an inch.

8. The needle thread tension control system of claim 5 wherein said V-shaped cross section includes first and second opposing annular faces having an included angle of approximately 135°.

9. The needle thread tension control system of claim 5 wherein said thread tension control post further includes:

an end normally inboard on a sewing machine; and an opposite end normally extending outboard of a sewing machine;

said V-shaped cross section including first and second opposing annular faces;

said first circumferential face facing inboard at an angle of approximately 15° to the central axis of the cylindrical thread tension control post; and said second circumferential face facing outboard at an angle of approximately 30° to the central axis of said cylindrical thread tension control post.

10. The needle thread tension control post of claim 4 wherein said thread tension control post further includes;

an inboard end normally secured to a sewing machine and, an outboard end normally extending away from a sewing machine.

11. The needle thread tension control system of claim 10 wherein said outboard end of said thread tension control post includes a winding mandrel for facilitating formation of said wrap of thread disposed about said thread tension control post.

12. The needle thread tension control of claim 11 wherein said winding mandrel comprises an annular shoulder disposed on said outboard end of said thread tension control post and a cylindrical body portion disposed between said annular groove and said annular shoulder.

13. The needle thread tension control system of claim 11 further including a cover extending over said tension control system, said tension control post being recessed behind said cover, said cover including an aperture and a slot, said winding mandrel extending through said aperture and said slot extending the length of said winding mandrel to facilitate threading of said tension control system.

* * * * *